US012139873B1

(12) United States Patent
Yang et al.

(10) Patent No.: US 12,139,873 B1
(45) Date of Patent: Nov. 12, 2024

(54) TUBE JOINT APPARATUS FOR DOUBLE-TUBE FLOATING TUNNEL AND CONSTRUCTION METHOD THEREOF

(71) Applicant: TIANJIN RESEARCH INSTITUTE FOR WATER TRANSPORT ENGINEERING, M.O.T. CHINA, Tianjin (CN)

(72) Inventors: Zhiwen Yang, Tianjin (CN); Huaqing Zhang, Tianjin (CN); Yonggang Cui, Tianjin (CN)

(73) Assignee: TIANJIN RESEARCH INSTITUTE FOR WATER TRANSPORT ENGINEERING, M.O.T. CHINA, Tianjin (CN)

( * ) Notice: Subject to any disclaimer, the term of this patent is extended or adjusted under 35 U.S.C. 154(b) by 0 days.

(21) Appl. No.: 18/798,140

(22) Filed: Aug. 8, 2024

Related U.S. Application Data

(63) Continuation of application No. PCT/CN2022/107806, filed on Jul. 26, 2022.

(51) Int. Cl.
*E02D 29/067* (2006.01)
*E02B 3/16* (2006.01)

(52) U.S. Cl.
CPC ..... *E02D 29/067* (2013.01); *E02B 3/16* (2013.01)

(58) Field of Classification Search
CPC ... E02D 29/067; E02D 29/072; E02D 29/045; E02B 29/16; E02B 3/16
See application file for complete search history.

(56) References Cited

U.S. PATENT DOCUMENTS 629,135 A * 7/1899 Nixon et al. ..... E02D 29/073 405/137
3,738,112 A * 6/1973 Grant ..... E02D 29/067 405/136
3,901,038 A * 8/1975 Olsen ..... E02D 29/073 405/136
5,899,635 A * 5/1999 Kuja ..... E02D 29/067 405/134

(Continued)

FOREIGN PATENT DOCUMENTS

CN 102312448 A 1/2012
CN 111254981 A 6/2020

(Continued)

*Primary Examiner* — Benjamin F Fiorello
(74) *Attorney, Agent, or Firm* — Birchwood IP

(57) ABSTRACT

A tube joint apparatus for a double-tube floating tunnel and a construction method thereof are provided, the apparatus includes a joint device, a tunnel tube body, and an escape device. The escape device is provided in the joint device, the tunnel tube body is respectively connected to left and right ends of the joint device. A plurality of anchor yokes are connected to an outside of the joint device. The joint device includes a watertight locking structure section, a framework connection section, and a main functional section. The main functional section includes a joint inner road surface and a joint housing. The joint inner road surface is provided in the joint housing, and the watertight locking structure section is respectively connected to two ends of the framework connection section. The present disclosure improves a utilization rate of an internal space in the underwater floating tunnel.

4 Claims, 10 Drawing Sheets

(56) References Cited

U.S. PATENT DOCUMENTS

| | | | | |
|---|---|---|---|---|
| 10,563,372 | B1 * | 2/2020 | Huang | E02D 29/06 |
| 11,136,740 | B1 * | 10/2021 | Du | E02D 29/067 |
| 11,313,099 | B2 * | 4/2022 | Jin | E02D 29/067 |
| 2020/0095746 | A1 * | 3/2020 | Du | E01B 25/00 |

FOREIGN PATENT DOCUMENTS

| | | | |
|---|---|---|---|
| CN | 111254984 | A | 6/2020 |
| CN | 112878374 | A | 6/2021 |
| CN | 114150702 | A | 3/2022 |
| JP | H1161863 | A | 3/1999 |
| KR | 1020100120326 | A | 11/2010 |

* cited by examiner

TUBE JOINT APPARATUS FOR DOUBLE-TUBE FLOATING TUNNEL AND CONSTRUCTION METHOD THEREOF

CROSS-REFERENCE TO RELATED APPLICATIONS

This application is a continuation of International Application No. PCT/CN2022/107806, filed on Jul. 26, 2022, which claims priority to Chinese Patent Application No. 202210125007.0, filed on Feb. 10, 2022, both of which are hereby incorporated by reference in their entireties.

TECHNICAL FIELD

The present disclosure relates to the field of basic equipment for underwater tunnel transportation technologies, and in particular, to a tube joint apparatus for a double-tube floating tunnel and a construction method thereof.

BACKGROUND

Floating tunnel is a large-scale cross sea transportation structure that is suspended in water. It is another disruptive transportation technology for humans to achieve deep-sea fjord crossing in the future, following cross sea bridges and underwater tunnels. Compared with traditional ultra deep water large-scale cross sea channels, floating tunnels can theoretically be constructed in any water area with long spans, large water depths, and steep bottom beds. Which mainly solve a problem of transportation crossing in wide water areas and deep water fjords, and are an effective way to connect ultra long spans and ultra deep water straits such as the Taiwan Strait, Qiongzhou Strait, and Bohai Strait in the future. They have great engineering application value and have received high attention from the academic and engineering communities at home and abroad in recent years. This new mode of transportation was proposed in the 1860s, but currently there is no precedent for its construction worldwide, nor has it formed a comprehensive theoretical system. The biggest technical challenge lies in controlling a motion response of complex structural systems in complex dynamic environments, maintaining system stability, and controlling risk factors such as internal leaks, sudden fires, and explosions that may occur in tunnels. At present, floating tunnels need to cross deep and large straits, with a length of tens or even hundreds of kilometers, submerged at 30-50 meters underwater. From a construction perspective, it is evident that the tunnel body cannot be prefabricated as a whole and must be joined together using multiple joint devices to form a cohesive whole. In long-term high-pressure, high salt, and high humidity environments, the strength, water tightness, and durability of the joint device can directly determine the success or failure of the entire floating tunnel, which is a crucial link in the floating tunnel structural system.

At present, both domestic and foreign underwater tunnel joint devices refer to the method of immersed tube tunnels. Due to the special external dynamic environment and usage requirements, floating tunnels obviously cannot directly refer to the design of immersed tube tunnel joints. The Chinese invention patent with application number of 202110059680.4 discloses a floating tunnel connection component, which includes a cylinder and N arc-shaped plates. The outer diameters of the cylinder and the arc-shaped plates are the same, and N arc-shaped plates are connected to one end of the cylinder and arranged at equal intervals along a circumference of the cylinder; Chinese invention patent with application number of 202010065308. X discloses a tube joint connection structure for an underwater cable-stayed floating tunnel. The tube joint is a socket type structure, and multiple countersunk joint bolt holes are uniformly distributed radially on an outer surface of the socket and an inner surface of the socket of each tube joint.

The existing technical solutions mentioned above have the following defects: the floating tunnel joint device is a "point-to-point" docking between adjacent tube bodies, and a docking length of adjacent tube bodies is relatively short, which renders it difficult to meet the design requirements of "joint stiffness must not be lower than the stiffness of the tube body itself" and poses a significant safety risk.

In this regard, the present application proposes a tube joint apparatus for a double-tube floating tunnel and a construction method thereof to solve the above-mentioned technical problems.

SUMMARY

The present disclosure provides a tube joint apparatus for a double-tube floating tunnel and a construction method thereof, the tune joint apparatus includes a joint device, a tunnel tube body, and an escape device. The present disclosure integrates multiple functions such as a connection between adjacent tube sections, an installation of an anchor yoke, and escape. Compared with traditional floating tunnel joint devices that can only meet a single function, it improves a utilization rate of an internal space in the underwater floating tunnel, greatly reduces a complexity of an overall linear structure system of the floating tunnel, and reduces a safety risk of the tunnel.

The technical solution adopted by the present disclosure to solve the above technical problems is a tube joint apparatus for a double-tube floating tunnel, including a joint device, a tunnel tube body, and an escape device; the escape device is provided in the joint device, the tunnel tube body is respectively connected to left and right ends of the joint device; a plurality of anchor cables are connected to an outer side of the joint device; the joint device includes a watertight locking structure section, a framework connection section, and a main functional section; the main functional section includes a joint inner road surface and a joint housing; the joint inner road surface is provided in the joint housing, the watertight locking structure section is connected to both ends of the framework connection section; the watertight locking structure section includes a shear ring, a locking ring, and a connection ring, the shear ring is sleeved on an outside of the connection ring, the tunnel tube body is connected to the joint device after passing through the shear ring; the locking ring is sleeved on a connection between the tunnel tube body and the joint device for locking the tunnel tube body and the joint device.

In an embodiment of the present disclosure, the main functional section further includes a second emergency channel configured to communicate two parallel tunnel tube bodies; the escape device is interconnected with the second emergency channel through a first emergency channel parallel to a length direction of the tunnel tube body.

In an embodiment of the present disclosure, a passage door is provided between the escape device and the first emergency channel configured for evacuation and escape of trapped personnel in the tunnel.

In an embodiment of the present disclosure, the framework connection section is respectively connected to both ends of the main functional section; a pouring ring is provided in the framework connection section; the pouring ring is sleeved on an outside of the connection ring and configured to weld steel bars embedded in the tunnel tube body and the joint device.

In an embodiment of the present disclosure, the joint inner road surface main steel bars and the joint housing main steel bars are respectively buried in the joint inner road surface and the joint housing and are configured to resist a force of an external load on the joint device.

In an embodiment of the present disclosure, the tube body housing is provided with a friction ring near the joint device, the friction ring is a multi-ring deep groove structure and configured to increase a frictional force between the tunnel tube body and the joint device.

In an embodiment of the present disclosure, the friction ring is provided in the locking ring, and the friction ring is aligned with the locking ring, there is a gap between the locking ring and the friction ring; concrete is poured into the gap between the locking ring and the friction ring so as to lock and fix the tunnel tube body and the joint device.

In an embodiment of the present disclosure, an outside of the tunnel tube body is sleeved with a watertight ring, the watertight ring is located at a connection between the tunnel tube body and the joint device.

A construction method for a tube joint apparatus for a double-tube floating tunnel, including the following steps:

step 1: prefabricating the joint device and installing the escape device, prefabricating the joint device on land, and pushing the escape device into a corresponding space of the joint device;

step 2: installing a right tube section in the tunnel tube body, sealing both ends of the right tube section with a steel sealing door, installing the right tube section underwater, and dynamic positioning with a surface towing equipment;

step 3: incrementally launching the joint device, sleeving the joint device onto the right tube section with an incremental launching method so that two shear rings are sleeved onto two tubes of the right tube section, and all reserved tube inner road surface main steel bars and tube housing main steel bars in the right tube section passing through the connection ring and directly reaching an interior of the pouring ring;

step 4: welding and pouring the joint device and the right tube section, pouring concrete into a gap between the two locking rings on a right side of the joint device and two friction rings corresponding to the right tube section, locking the right tube section and a right end of the joint device;

step 5: pumping out water between the joint device and the right tube section with a high-pressure water pump, removing the two steel sealing doors installed at the joint device and the right tube section, completing a communication between the joint device and the right tube section;

step 6: installing the anchor cable, connecting the anchor cable corresponding to the joint device to its corresponding anchor yoke and seabed foundation in sequence;

step 7: following the installation steps of the joint device and the right tube section in steps 2 to 5 to achieve an incremental launching between a left tube section and the joint device, thereby completing an installation of the joint device with the right tube section and left tube section.

In an embodiment of the present disclosure, in step 4, after the right tube section is locked to a right end of the joint device, the joint housing main steel bars buried in the pouring ring on the right side of the joint device are welded to the tube inner road surface main steel bars, the joint inner road surface main steel bars are welded to the tube inner road surface main steel bars; after all steel bars are welded, a formwork support is carried out, and then concrete is filled and poured.

The advantage of the present disclosure is that it provides a tube joint apparatus for a double-tube floating tunnel and a construction method thereof, which has the following advantages.

1. The floating tunnel joint apparatus with emergency rescue function provided by the present disclosure includes a joint device, a tunnel tube body, and an escape device, and an anchor cable is provided on the outside of the joint device. The present disclosure integrates multiple functions such as a connection of adjacent tube sections, an installation of anchor cable, and escape. Compared with traditional floating tunnel joint device that can only meet a single function, it improves a utilization rate of an internal space in the underwater floating tunnel, greatly reduces a complexity of the overall linear structure system of the floating tunnel, and reduces the safety risk of the tunnel.
2. The joint device in the present disclosure includes a watertight locking structure section. Compared with the "point-to-point" mode of traditional floating tunnel joints without locking sections, this solution achieves "line section overlapping" between the tunnel tube body and the joint device, while filling and pouring concrete in other gaps, greatly improving the strength and integrity of the connection section and enhancing the safety performance of the connection structure.
3. The present disclosure provides two escape devices on the joint device, which adopt an "embedded" design. A bottom plate is flush with the tunnel road surface, and a top plate is flush with a top of the joint device, thereby reducing an impact of external wave and water flow. In emergency situations, trapped personnel can quickly enter the escape device without climbing stairs, greatly shortening the escape route, greatly improving rescue efficiency and personnel survival rate in emergency situations, and reducing losses.

BRIEF DESCRIPTION OF DRAWINGS

In order to provide a clearer explanation of the specific embodiments of the present disclosure or the technical solutions in the prior art, a brief introduction will be given to the accompanying drawings required for the description of the specific embodiments or the prior art. It is obvious that the accompanying drawings described below are some embodiments of the present disclosure. For those skilled in the art, other drawings can be obtained based on these drawings without creative work.

Numeral reference: 1—joint device; 101—ballast tank; 103—first emergency channel; 105—connection ring; 106—shear ring; 107—passage door; 1001—watertight locking structure section; 1002—framework connection section; 1003—main functional section; 2—tunnel tube body; 201—right tube section; 202—left tube section; 3—escape device; 4—anchor yoke; 5—vehicle; 6—anchor cable; 11—second emergency channel; 12—watertight ring; 13—pouring ring; 14—joint housing main steel bar; 15—locking ring; 16—joint inner road surface; 17—joint inner road surface main steel bar; 18—welding joints; 19—joint housing; 21—tube body housing; 22—friction ring; 23—tube inner road surface; 24—tube inner road surface main steel bar; 25—tube housing main steel bar.

DESCRIPTION OF EMBODIMENTS

The following will provide a clear and complete description of the technical solution of the present disclosure in combination with the accompanying drawings. Obviously, the described embodiments are only a part of the embodiments of the present disclosure, not all of them. Based on the embodiments of the present disclosure, all other embodiments obtained by ordinary skilled persons in the art without creative work are within the protection scope of the present disclosure.

In the description of the present disclosure, it should be noted that unless otherwise specified and limited, terms "center", "up", "down", "left", "right", "vertical", "horizontal", "inside", "outside" and other directional or positional relationships indicated are based on the directional or positional relationships shown in the accompanying drawings, only for a convenience of describing the present disclosure and simplifying the description, and do not indicate or imply that the device or member referred to must have a specific orientation, be constructed and operated in a specific orientation, and therefore cannot be understood as limiting the present disclosure. In addition, terms "first", "second", and "third" are only used for descriptive purposes and should not be understood as indicating or implying a relative importance. Terms "installation", "connection to", and "connection with" should be broadly understood, for example, they can be a fixed connection, a detachable connection, or an integral connection; it can be a mechanical connection or an electrical connection; it can be directly connected, indirectly connected through an intermediate medium, or connected internally between two components. For those skilled in the art, the specific meanings of the above terms in the present disclosure can be understood in specific situations.

Embodiment 1

Figure 1:
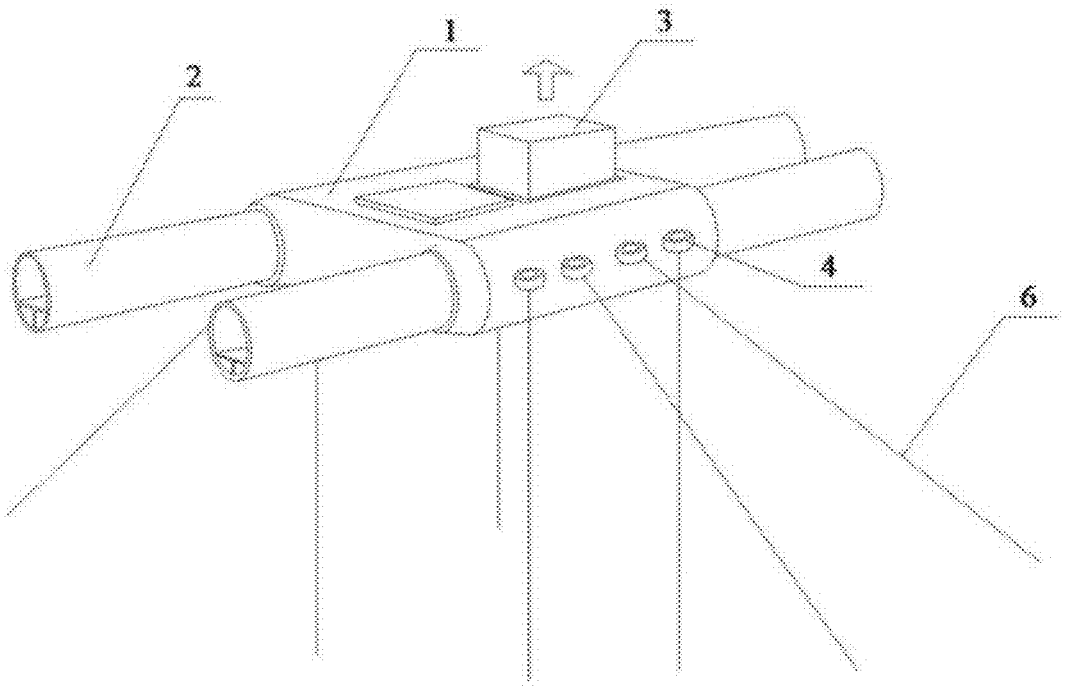
FIG. 1 is a schematic structural diagram of a floating tunnel joint device in the present disclosure.

FIG. 1 is a schematic structural diagram of a floating tunnel joint device in the present disclosure. As shown in FIG. 1, a tube joint apparatus for a double-tube floating tunnel includes a joint device 1, a tunnel tube body 2, an escape device 3, and an anchor yoke 4. The joint device 1 is configured to fixedly connect front and back ends of adjacent tunnel tube bodies 2 together. The tunnel tube body 2 is a tube section of the floating tunnel tube body 2 close to the joint device 1, and is a double or multiple tube structure.

There are two escape devices 3 fixedly connected in a middle area in the joint device 1, which are used for rapid evacuation of personnel in emergency situations. A plurality of anchor yokes 4 are fixedly connected on an outer side of the joint device 1 for an installation of an anchor cable 6 of the floating tunnel, all above structures are submerged at a depth of 30-50 meters below the sea surface.

In an implementation, a length of a single section tunnel tube body 2 is 150-180 meters, with a diameter that meets an effective width of two lanes. The length of the joint device 1 is 1/12-1/10 times the length of the tunnel tube 2, a width of the joint device 1 is 3-4 times a diameter of the tunnel tube body 2; an axial distance between two tunnel tube bodies 2 is 2-3 times the diameter of the tunnel tube body 2.

Figure 2:
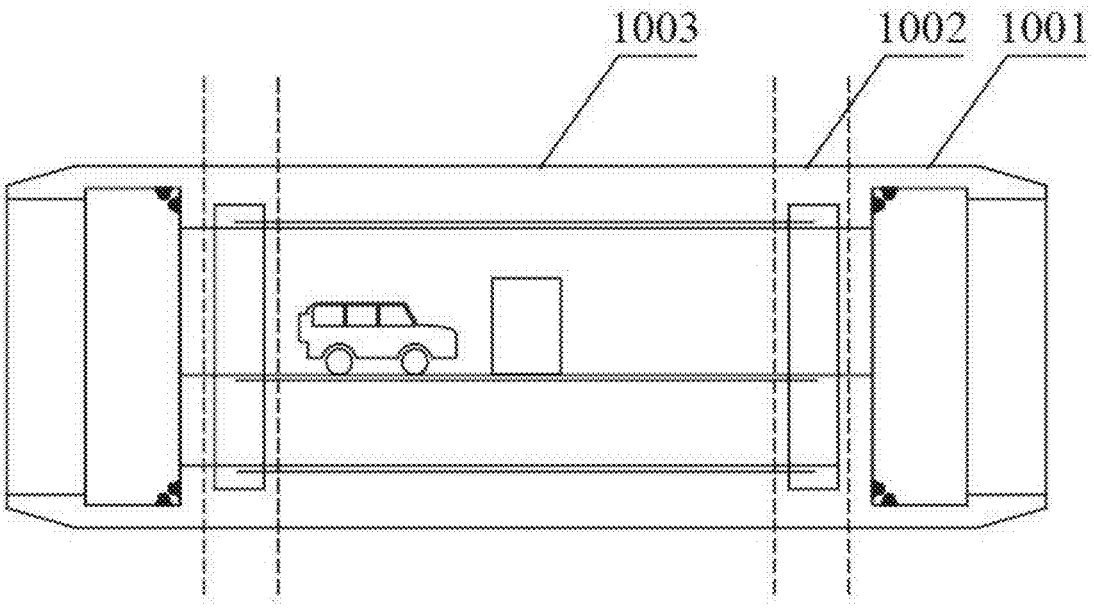
FIG. 2 is a schematic diagram of a sectioned structure of the floating tunnel joint device in the present disclosure.
Figure 3:
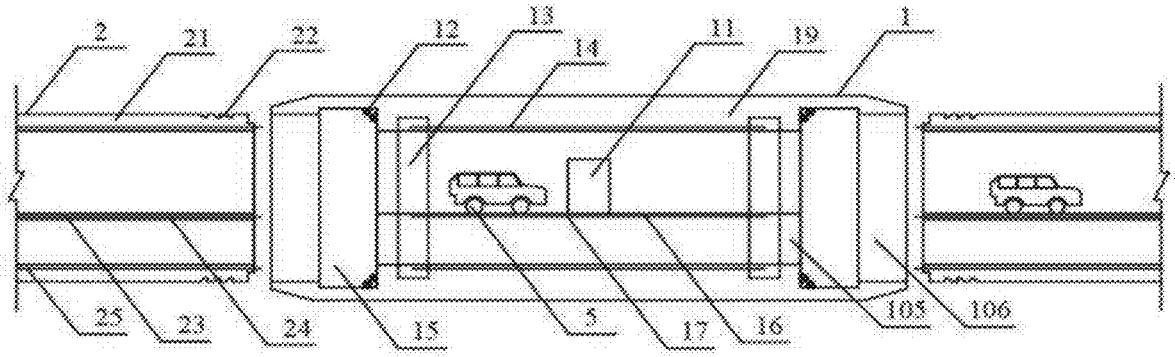
FIG. 3 is a schematic diagram of a cross-sectional structure of main components of the floating tunnel joint device and a tube body structure in the present disclosure.

FIG. 2 is a schematic diagram of a sectioned structure of the floating tunnel joint device in the present disclosure, and FIG. 3 is a schematic diagram of a cross-sectional structure of main components of the floating tunnel joint device and a tube body structure in the present disclosure. As shown in FIGS. 2 and 3, the joint device 1 is an axisymmetric structure in the plane, and from right to left in the cross-section, it includes a watertight locking structure section 1001, a framework connection section 1002, and a main functional section 1003. The main functional section 1003 includes a joint inner road surface 16 and a joint housing 19, the joint inner road surface 16 is provided in the joint housing 19; the watertight locking structure section 1001 is connected to both ends of the framework connection section 1002 as a whole, and the watertight locking structure section 1001 is a ring-shaped structure; the watertight locking structure section 1001 includes a shear ring 106, a locking ring 15, and a connection ring 105. The shear ring 106 is sleeved on an outside of the connection ring 105; the tunnel tube body 2 is fixedly connected to the joint device 1 after passing through the shear ring 106, and the locking ring 15 is sleeved at a connection between the tunnel tube body 2 and the joint device 1, used to lock and connect the tunnel tube body 2 and the joint device 1. An inner diameter of the shear ring 106 is consistent with an outer diameter of the tunnel tube body 2, an inner diameter of the locking ring 15 is larger than an outer diameter of the tunnel tube body 2, and a watertight ring 12 is a rubber structure with an inner diameter smaller than the outer diameter of the tunnel tube end. The watertight ring 12 can tightly wrap the end and outer edge of the tunnel tube body 2, effectively preventing an infiltration of external seawater; inner and outer diameters of the connection ring 105 are consistent with the inner and outer diameters of the tunnel tube body 2, and a cross-sectional shape is completely consistent with the cross-sectional shape of the tunnel tube body 2.

In an implementation, a length of the watertight locking structure section 1001 is 1/3 to 1/2.5 times a total length of the joint device 1.

The framework connection section 1002 in the joint device 1 is a ring-shaped cavity structure, including a pouring ring 13, configured to weld steel bars embedded in the tunnel tube body 2 and the joint device 1. After the steel bars are welded, concrete is poured to ensure a strength of the connection between the tunnel tube body 2 and the joint device 1, and improve an overall structural safety performance.

The main functional section 1003 in the joint device 1 includes a joint inner road surface 16, a joint housing 19, and a second emergency channel 11 for communicating two parallel arranged tube bodies. The joint inner road surface 16 is used for a normal passage of vehicles 5. The joint inner road surface 16 and the joint housing are respectively embedded with joint inner road surface main steel bar 17 and joint housing main steel bars 14 to resist a force of an external load on the joint structure.

Figure 10:
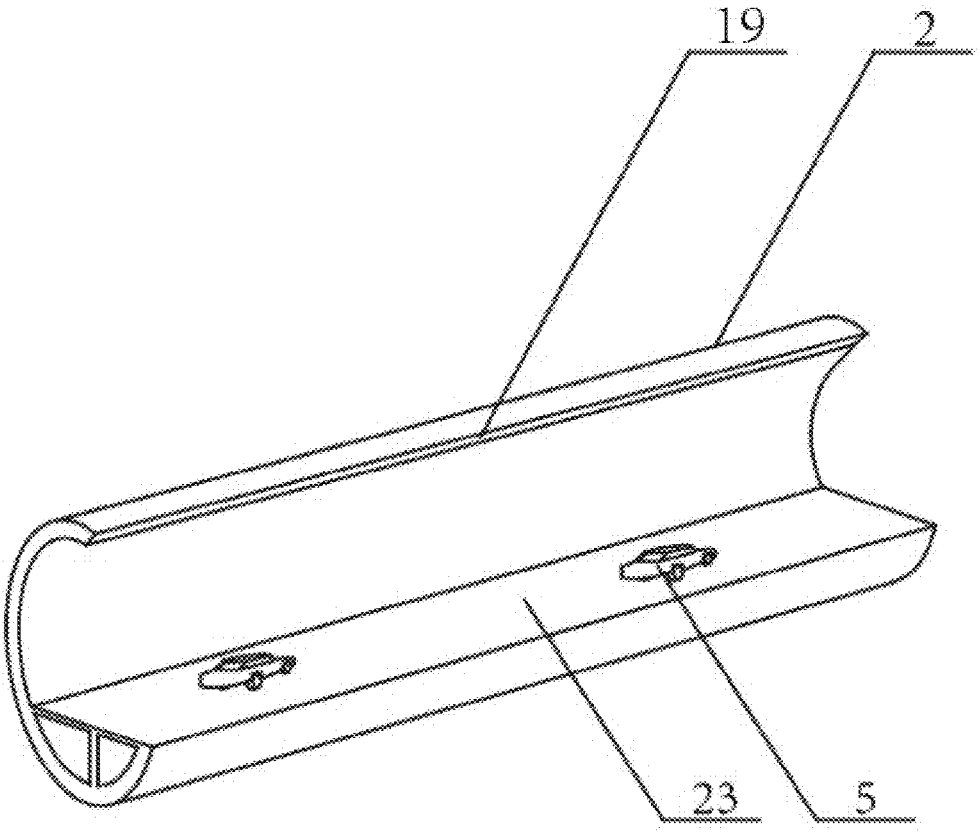
FIG. 10 is a schematic diagram of an internal sectional structure of the tunnel tube body in the present disclosure.

The tunnel tube body 2 includes a tube body housing 21 and a friction ring 22 located near the end of the tube body housing 21. The friction ring 22 is composed of multiple annular deep grooves, as shown in FIG. 10. A tube inner road surface 23 is provided in the tube body, and tube inner road surface main steel bars 24 and tube body housing main steel bars 21 are respectively buried in the tuber inner road surface 23 and the tube body housing 21 to resist a force of an external load on the tube body structure.

Figure 4:
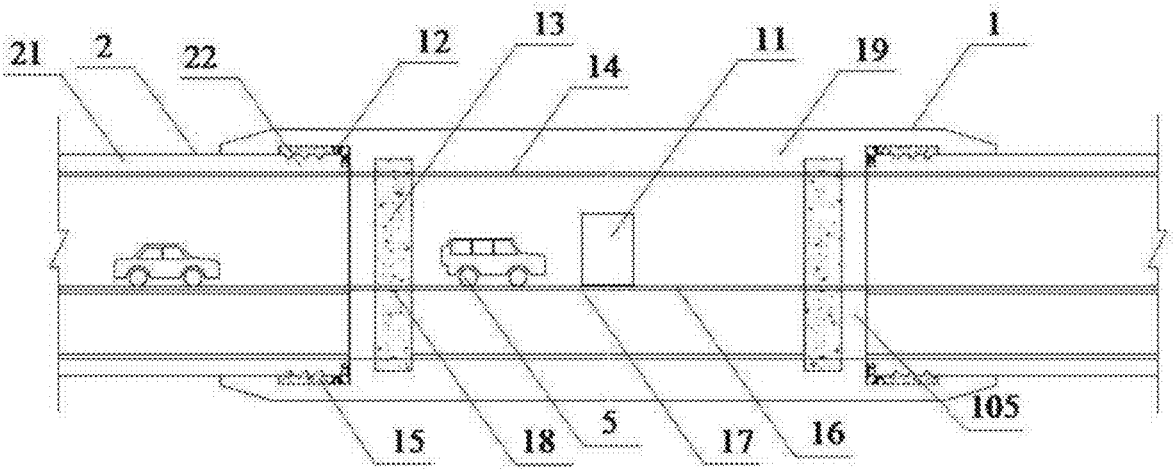
FIG. 4 is a schematic diagram of a connection structure between a floating tunnel tube body and the joint device in the present disclosure (section I-I).

FIG. 4 is a schematic diagram of a connection structure between a floating tunnel tube body and the joint device in the present disclosure. As shown in FIG. 4, the tunnel tube body 2 passes through the shear ring 106 and is docked with the joint device 1. After the connection between the tunnel tube body 2 and the joint device 1 is completed, the locking ring 15 is aligned with the friction ring 22. Concrete is poured into a gap between the locking ring 15 and the friction ring 22 so as to lock the tunnel tube body 2 and the joint device 1. A deep groove on the friction ring 22 can increase a friction between the tube body and the joint, thereby improving the strength of the connection between the two. The joint inner road surface 16 is flush with the tube inner road surface 23. All buried tube inner road surface main steel bars 24 in the tunnel tube body 2 and the main steel bars of the tube body housing 21 can pass through the connection ring 105 and directly reach an interior of the pouring ring 13. They are welded to the corresponding buried joint inner road surface main steel bars 17 in the joint device 1 and joint housing main steel bars 14 in the joint housing. After all steel bars are welded, the concrete is filled and poured, and an outer wall of the pouring ring 13 is kept flush with an inner wall of the tunnel.

Figure 5:
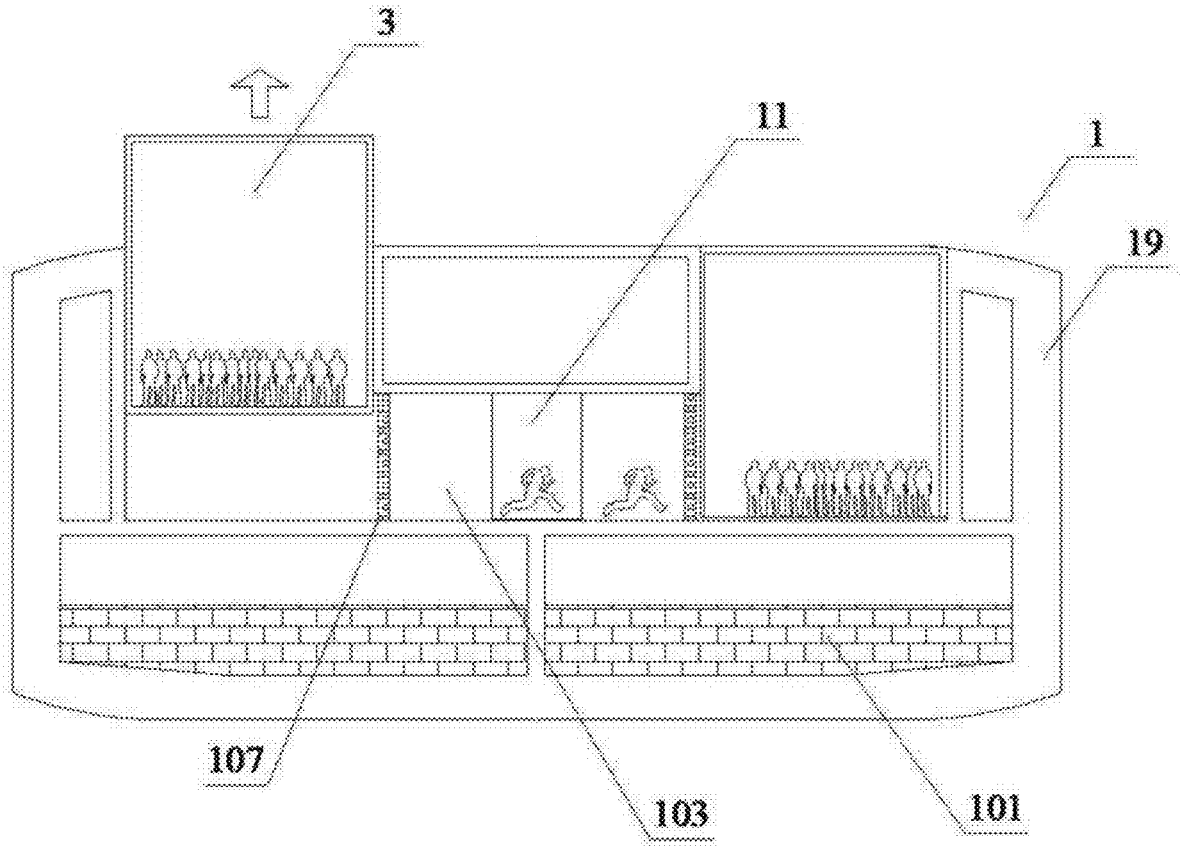
FIG. 5 is a schematic structural diagram of a floating tunnel escape device in the present disclosure (section II-II).
Figure 6:
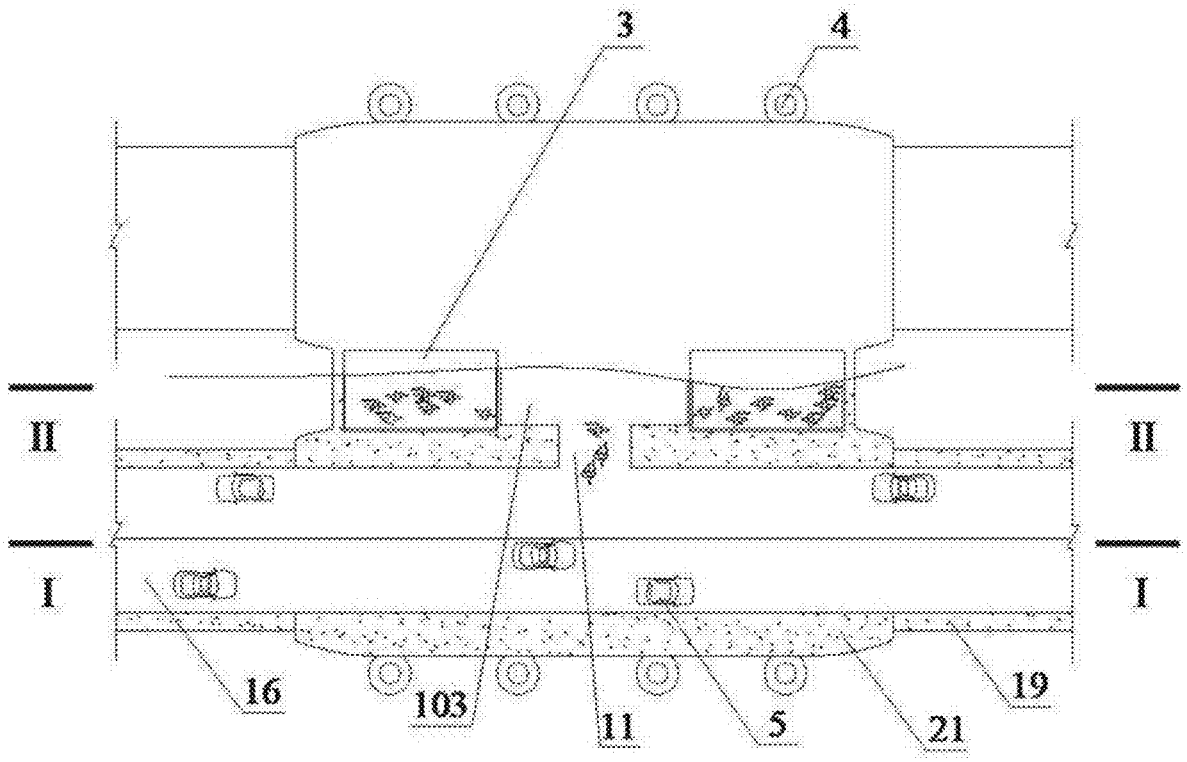
FIG. 6 is a semi sectional structural schematic diagram of the floating tunnel joint device in the present disclosure.

FIG. 5 is a schematic structural diagram of a floating tunnel escape device in the present disclosure, and FIG. 6 is a semi sectional structural schematic diagram of the floating tunnel joint device in the present disclosure. As shown in FIGS. 5 and 6, two escape devices 3 are provided in a middle area of the joint device 1 where two parallel tube sections are connected. The escape device 3 in the present disclosure adopts the escape equipment in the current existing technology (such as the escape system disclosed in the invention patent with publication number of CN111254978A). The escape device 3 is communicated to the second emergency channel 11 through the first emergency channel 103 parallel to a length direction of the tunnel tube body 2. A ballast tank 101 is further provided below the escape device 3 to adjust a self-weight of the joint structure. A top of the escape device 3 is flush with a top of the joint, and a bottom is flush with the road surface in the tunnel.

Figure 7:
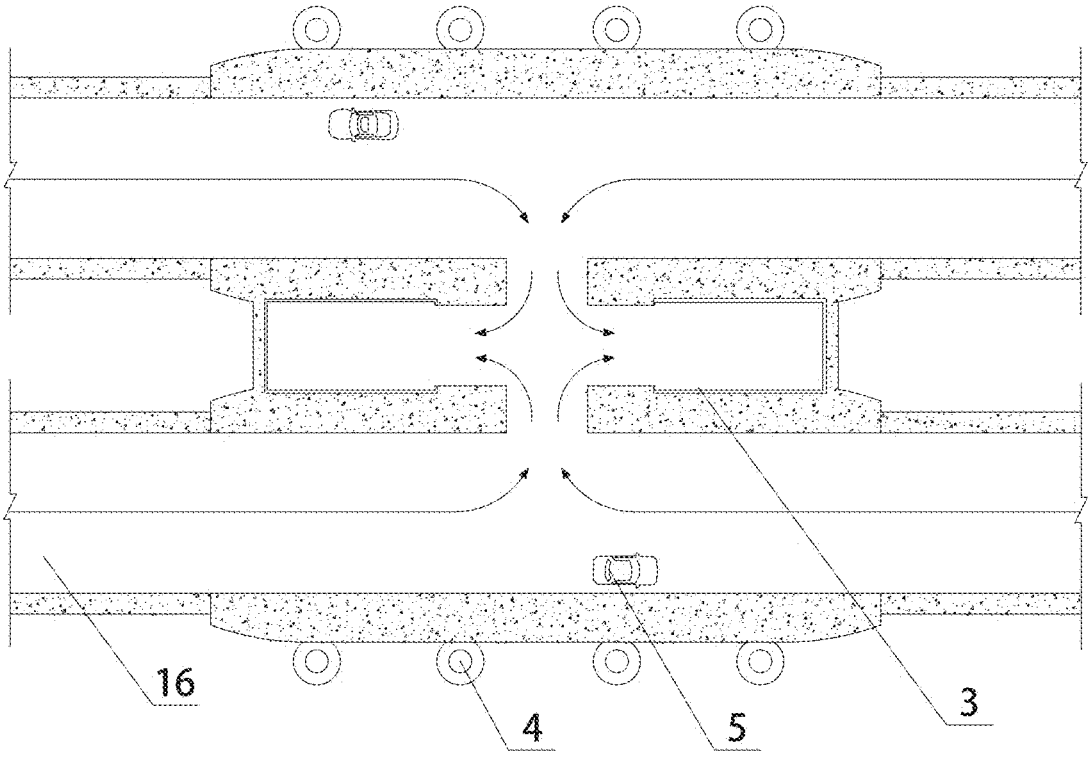
FIG. 7 is a schematic diagram of an escape route for trapped personnel in the floating tunnel joint device in the present disclosure.

A passage door 107 is provided between the escape device 3 and the first emergency channel 103, as shown in FIG. 7. In the event of a sudden fire, explosion, or terrorist bombing inside the tunnel, trapped personnel can immediately evacuate the road surface and pass through the second emergency passage 11, the first emergency channel 103, and the passage door 107 to enter the escape passage device. The system will then automatically close the passage door 107 and eject the escape device 3. The escape device 3 will rise to the sea surface under its own buoyancy, waiting for emergency rescue from the sea surface.

The present disclosure further provides a construction method for a tube joint apparatus for a double-tube floating tunnel, taking an installation order from right to left as an example, which specifically includes the following steps:

step 1: prefabricating the joint device 1 and installing the escape device 3:

according to design drawings, a dry construction method is used to prefabricate the joint device 1 on land, a sufficient length of the joint inner road surface main steel bars 17 and joint housing main steel bars 14 are reserved. Then the passage door 107 is installed and steel sealing doors are installed at four connection rings 105 of the joint device 1, strict sealing treatment is performed, thereby ensuring sufficient water tightness, and preventing water from entering the main functional section 1003 of the joint device 1 during underwater installation. Then the passage door 107 is closed and the escape device 3 is pushed into a corresponding space of the joint device 1.

Step 2: installing a right tube section.

steel sealing doors are used to seal two ends of the right tube section 201.

Professional installation equipment and underwater positioning systems are used to install the right tube section 201 at a certain depth underwater according to design requirements, and dynamic positioning is carried out with a surface towing equipment to ensure that an error between an axis of the tunnel tube body 2 and a designated position meets the design requirements, and a displacement and a posture of the tunnel tube body 2 meet the design requirements. A distance between double tube axis of the tunnel tube body 2 is 2-3 times a diameter of the tunnel, and the two tube are kept parallel to each other. Cross-sections at ends of the two tubes are in a plane perpendicular to the tube axis.

Step 3: incrementally launching the joint device 1.

as shown in FIGS. 3 and 4 of this specification, a specialized installation equipment is used for floating tunnels, the incremental launching method is used, the joint device 1 is sleeved on the right tube section 201 so that two shear rings 106 on a right side of the joint device 1 are precisely sleeved onto the two tubes of the right tube section 201, and the two locking rings 15 on the right side of the joint device 1 are aligned with the two friction rings 22 corresponding to the right tube section 201. Two watertight rings 12 tightly wrap the ends and outer edges of the corresponding two right tube sections 201. The joint inner road surface 16 is flush with the tube inner road surface 23 inside the right tube section 201, and all reserved tube inner road surface main steel bars 24 in the tube inner road surface and the main steel bars of the tube housing 21 in the right tube section 201 pass through the connection ring 105 and directly reach an interior of the pouring ring 13.

Step 4: welding and pouring the joint device 1 and the right tube section 201.

concrete is poured into the gap between the two locking rings 15 on the right side of the joint device 1 and the two friction rings 22 corresponding to the right tube section 201, and the right tube section 201 is locked with the right end of the joint device 1. The main steel bars of the tunnel tube body 2 and the main steel bars of the joint structure buried in the pouring ring 13 are welded on the right side of the joint device 1 in sequence. After all steel bars are welded, a formwork support is performed, and then the concrete is filled and poured. After pouring, an outer wall of the pouring ring 13 is kept flush with an inner wall of the tunnel.

Step 5: Communicating the joint device 1 and the right tube section 201.

a high-pressure water pump is used to pump out water between the joint device 1 and the right tube section 201, and then the two steel sealing doors installed in advance at the joint device 1 and the right tube section 201 are removed, thus completing the communication between the joint device 1 and the right tube section 201.

Figure 8:
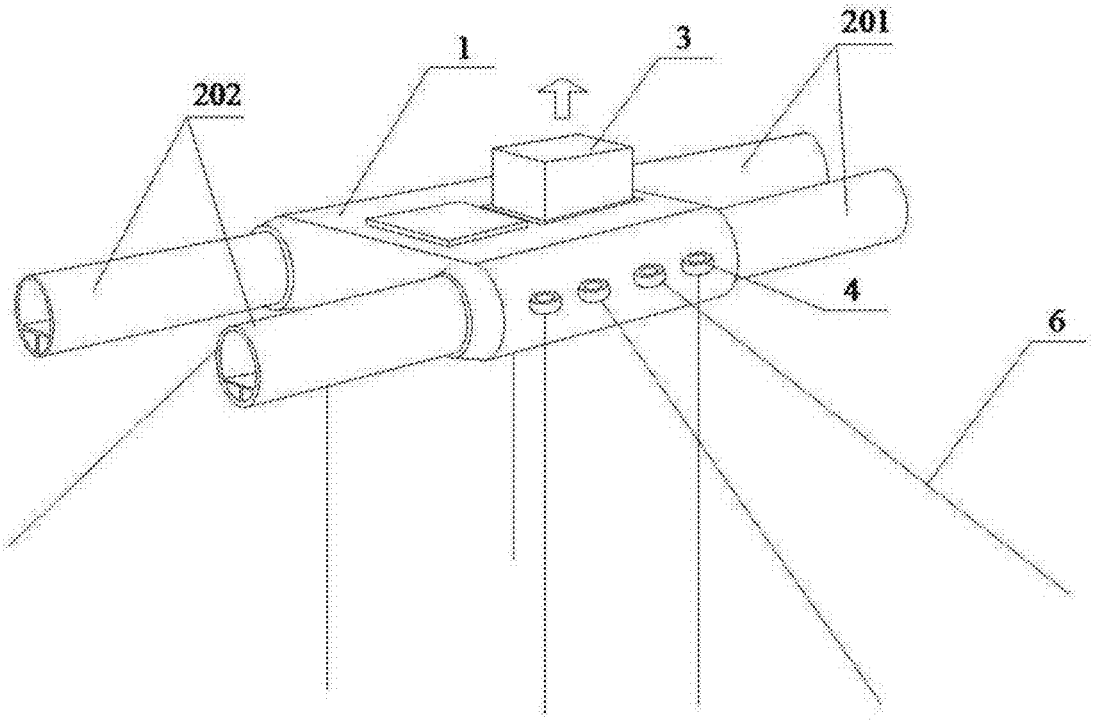
FIGS. 8 and 9 are schematic structural diagrams of the floating tunnel joint device, tunnel tube body, and an anchor cable in the present disclosure after installation.
Figure 9:
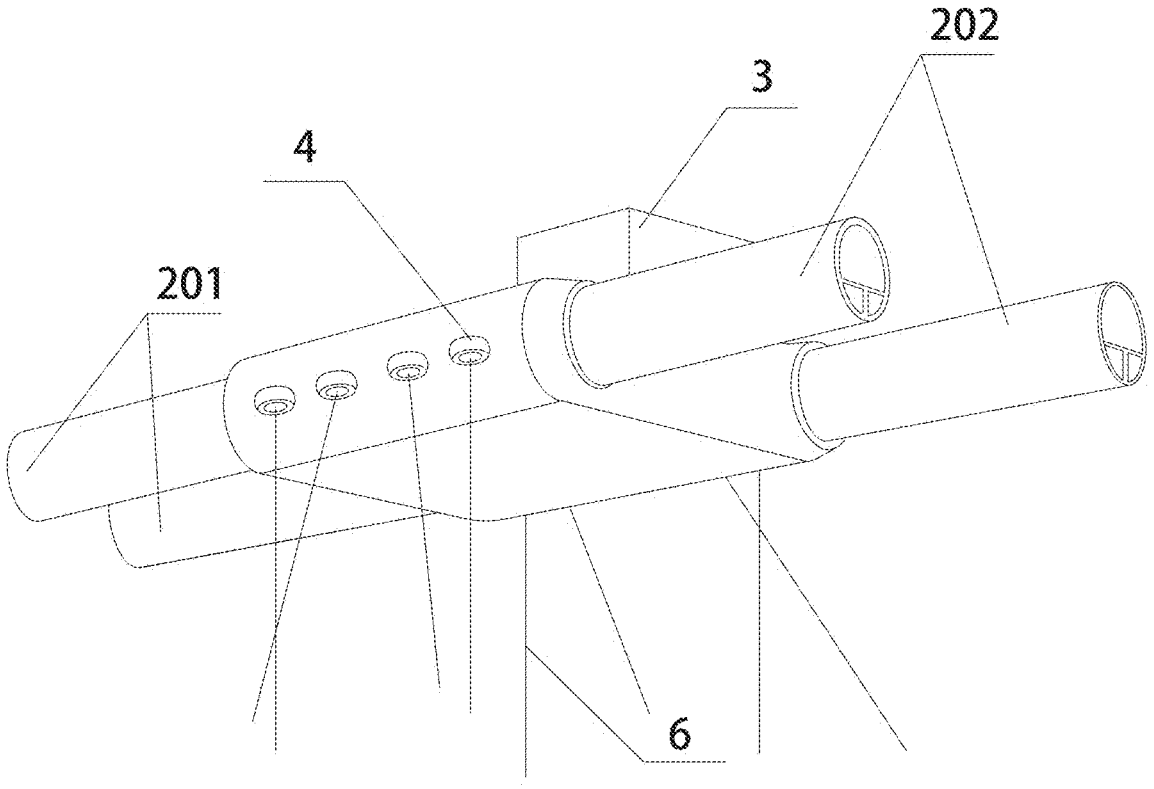

Step 6: installing the anchor cable 6.

as shown in FIGS. 8 and 9 of this specification, after the incremental launching, steel bar welding, and concrete pouring are completed between the joint device 1 and the right tube section 201, the corresponding anchor cable 6 of the joint device 1 is connected to its corresponding anchor yoke 4 and seabed foundation in sequence, thereby further improving an overall structural stability of the joint device 1 and the right tube section 201.

Step 7: incrementally launching a left tube section 202 and the joint device 1.

similarly, steps 2 to 5 are repeated and similar steps are taken to complete the incremental launching between the left tube section 202 and the joint device 1. At this point, all installation work for the joint device 1 with the right tube section 201 and the left tube section 202 has been completed.

Finally, it should be noted that the above embodiments are only used to illustrate the technical solution of the present disclosure, and not to limit it; although the present disclosure has been described in detail with reference to the aforementioned embodiments, those skilled in the art should understand that they can still modify the technical solutions described in the aforementioned embodiments, or equivalently replace some or all of the technical features therein; and these modifications or substitutions do not deviate from the essence of the corresponding technical solutions from the scope of the various embodiments of the present disclosure.

What is claimed is:

1. A construction method for a tube joint apparatus for a double-tube floating tunnel, wherein the tube joint apparatus comprises a joint device, a tunnel tube body, and an escape device; the escape device is provided in the joint device, the tunnel tube body is respectively connected to left and right ends of the joint device; a plurality of anchor yokes are connected to an outer side of the joint device;

wherein the joint device comprises a watertight locking structure section, a framework connection section, and a main functional section; the main functional section comprises a joint inner road surface and a joint housing; the joint inner road surface is provided in the joint housing, the watertight locking structure section is connected to both ends of the framework connection section; the watertight locking structure section comprises a shear ring, a locking ring, and a connection ring, wherein the shear ring is sleeved on an outside of the connection ring, the tunnel tube body is connected to the joint device after passing through the shear ring; the locking ring is sleeved on a connection between the tunnel tube body and the joint device for locking the tunnel tube body and the joint device;

a ballast tank is provided below the escape device for adjusting a self-weight of the joint device; the framework connection section is respectively connected to both ends of the main functional section; a pouring ring is provided in the framework connection section; the pouring ring is sleeved on an outside of the connection ring and configured to weld steel bars embedded in the tunnel tube body and the joint device; the tube body housing is provided with a friction ring near the joint device; the friction ring is a multi-ring deep groove structure and configured to increase a frictional force between the tunnel tube body and the joint device; the friction ring is provided in the locking ring, and the friction ring is aligned with the locking ring, there is a gap between the locking ring and the friction ring; concrete is poured into the gap between the locking ring and the friction ring so as to lock and fix the tunnel tube body and the joint device; the main functional section further comprises a second emergency channel configured to communicate two parallel tunnel tube bodies; the escape device is interconnected with the second emergency channel through a first emergency channel parallel to a length direction of the tunnel tube body;

wherein the construction method comprises the following steps:

step 1: prefabricating the joint device and installing the escape device, prefabricating the joint device on land, and pushing the escape device into a corresponding space of the joint device;

step 2: installing a right tube section in the tunnel tube body, sealing both ends of the right tube section with a steel sealing door, installing the right tube section underwater, and dynamic positioning with a surface towing equipment;

step 3: incrementally launching the joint device, sleeving the joint device onto the right tube section with an incremental launching method so that two shear rings are sleeved onto two tubes of the right tube section, and all reserved tube inner road surface main steel bars and tube housing main steel bars in the right tube section passing through the connection ring and directly reaching an interior of the pouring ring;

step 4: welding and pouring the joint device and the right tube section, pouring concrete into a gap between the two locking rings on a right side of the joint device and two friction rings corresponding to the right tube section, locking the right tube section and a right end of the joint device;

step 5: pumping out water between the joint device and the right tube section with a high-pressure water pump, removing the two steel sealing doors installed at the joint device and the right tube section, completing a communication between the joint device and the right tube section;

step 6: installing the anchor cable, connecting the anchor cable corresponding to the joint device to its corresponding anchor yoke and seabed foundation in sequence;

step 7: following the installation steps of the joint device and the right tube section in steps 2 to 5 to achieve an incremental launching between a left tube section and the joint device, thereby completing an installation of the joint device with the right tube section and left tube section;

wherein in step 4, after the right tube section is locked to a right end of the joint device, the joint housing main steel bars buried in the pouring ring on the right side of the joint device are welded to the tube inner road surface main steel bars, the joint inner road surface main steel bars are welded to the tube inner road surface main steel bars; after all steel bars are welded, a formwork support is carried out, and then concrete is filled and poured.

2. The construction method for a tube joint apparatus for a double-tube floating tunnel according to claim 1, wherein a passage door is provided between the escape device and the first emergency channel configured for evacuation and escape of trapped personnel in the tunnel.

3. The construction method for a tube joint apparatus for a double-tube floating tunnel according to claim 1, wherein the joint inner road surface main steel bars and the joint housing main steel bars are respectively buried in the joint inner road surface and the joint housing configured to resist a force of an external load on the joint device.

4. The construction method for a tube joint apparatus for a double-tube floating tunnel according to claim 1, wherein an outside of the tunnel tube body is sleeved with a watertight ring, the watertight ring is located at a connection between the tunnel tube body and the joint device.

* * * * *